US009506131B2

(12) United States Patent
Kojima et al.

(10) Patent No.: US 9,506,131 B2
(45) Date of Patent: Nov. 29, 2016

(54) STEEL SHEET FOR AEROSOL CAN BOTTOM HAVING HIGH PRESSURE RESISTANCE AND EXCELLENT WORKABILITY AND METHOD FOR PRODUCING SAME

(75) Inventors: Katsumi Kojima, Fukuyama (JP); Takumi Tanaka, Fukuyama (JP); Mikito Suto, Chiba (JP); Masaki Tada, Fukuyama (JP); Yoichi Tobiyama, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 357 days.

(21) Appl. No.: 14/005,126

(22) PCT Filed: Mar. 15, 2012

(86) PCT No.: PCT/JP2012/057409
§ 371 (c)(1),
(2), (4) Date: Sep. 13, 2013

(87) PCT Pub. No.: WO2012/124823
PCT Pub. Date: Sep. 20, 2012

(65) Prior Publication Data

US 2014/0007990 A1 Jan. 9, 2014

(30) Foreign Application Priority Data

Mar. 17, 2011 (JP) ..... 2011-058768

(51) Int. Cl.
*C22C 38/02* (2006.01)
*C22C 38/04* (2006.01)
*C22C 38/06* (2006.01)
(Continued)

(52) U.S. Cl.
CPC ..... *C22C 38/08* (2013.01); *B65D 83/38* (2013.01); *C21D 8/005* (2013.01); *C21D 8/021* (2013.01); *C21D 8/0205* (2013.01); *C21D 8/0226* (2013.01); *C21D 8/0436* (2013.01); *C21D 8/0442* (2013.01); *C21D 8/0473* (2013.01); *C22C 1/02* (2013.01); *C22C 38/001* (2013.01); *C22C 38/02* (2013.01); *C22C 38/04* (2013.01); *C22C 38/06* (2013.01); *C21D 2211/004* (2013.01); *C21D 2211/005* (2013.01)

(58) Field of Classification Search
None
See application file for complete search history.

(56) References Cited

FOREIGN PATENT DOCUMENTS

| | | |
|---|---|---|
| EP | 2050834 | 4/2009 |
| EP | 2138596 | 12/2009 |

(Continued)

OTHER PUBLICATIONS

European Search Report mailed May 21, 2015 for European Application No. 12757575.1.

(Continued)

*Primary Examiner* — Deborah Yee
(74) *Attorney, Agent, or Firm* — RatnerPrestia

(57) ABSTRACT

A steel sheet containing C: 0.02% or more and 0.10% or less, Si: 0.01% or more and 0.5% or less, P: 0.001% or more and 0.100% or less, S: 0.001% or more and 0.020% or less, N: 0.007% or more and 0.025% or less, Al: 0.01% or more and {−4.2×N (%)+0.11}% or less, Mnf: 0.10% or more and less than 0.30% where Mnf is defined by equation Mnf=Mn−1.71×S, and the balance being Fe and inevitable impurities, in which the steel sheet has a thickness of 0.35 (mm) or less, the product of the lower yield point ($N/mm^2$) of the steel sheet and the thickness (mm) is 160 (N/mm) or less, and the product of the upper yield point ($N/mm^2$) of the steel sheet is 52.0 (N) or more.

4 Claims, 1 Drawing Sheet

(51) Int. Cl.

| | |
|---|---|
| ***C21D 8/04*** | (2006.01) |
| ***C21D 8/02*** | (2006.01) |
| ***C22C 38/08*** | (2006.01) |
| ***C22C 38/00*** | (2006.01) |
| ***B65D 83/38*** | (2006.01) |
| ***C21D 8/00*** | (2006.01) |
| ***C22C 1/02*** | (2006.01) |

(56) References Cited

FOREIGN PATENT DOCUMENTS

| | | | |
|---|---|---|---|
| EP | 2253729 | | 11/2010 |
| EP | 2650396 | | 10/2013 |
| JP | 04-350146 | | 12/1992 |
| JP | 07-278744 | A | 10/1995 |
| JP | 08-311609 | A | 11/1996 |
| JP | 10-017993 | | 1/1998 |
| JP | 2001-279372 | A | 10/2001 |
| JP | 2004-323906 | A | 11/2004 |
| JP | 2007177315 | | 7/2007 |
| JP | 2008-208399 | A | 9/2008 |
| JP | 2009-263788 | A | 11/2009 |

OTHER PUBLICATIONS

International Search Report dated Jun. 19, 2012, application No. PCT/JP2012/057409.

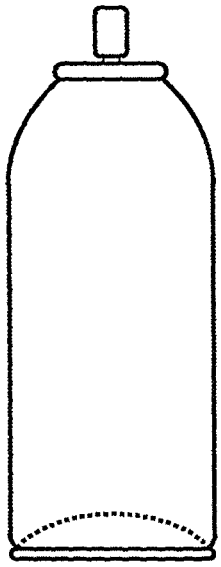

STEEL SHEET FOR AEROSOL CAN BOTTOM HAVING HIGH PRESSURE RESISTANCE AND EXCELLENT WORKABILITY AND METHOD FOR PRODUCING SAME

CROSS REFERENCE TO RELATED APPLICATIONS

This application is the U.S. National Phase application of PCT International Application No. PCT/JP2012/057409, filed Mar. 15, 2012, and claims priority to Japanese Patent Application No. 2011-058768, filed Mar. 17, 2011, the disclosures of both applications being incorporated herein by reference in their entireties for all purposes.

FIELD OF THE INVENTION

The present invention relates to a steel sheet to be used for the bottom of an aerosol can and a method for manufacturing the steel sheet, and, in particular, relates to a steel sheet to be used for the bottom of an aerosol can having high resistance to pressure and high formability and a method for manufacturing the steel sheet.

BACKGROUND OF THE INVENTION

Aerosol cans have various structures, and an example is one having a bottom made of steel which is seamed to a can body. FIG. 1 illustrates the structure of an aerosol can to which a bottom is attached. A bottom 1 to be attached to the aerosol can illustrated in FIG. 1 is made from a circular blank, which is stamped out from a material. The blank is formed into a specified shape by press forming and seamed to a can body 2 using a flange formed in the peripheral portion thereof. A mounting cap 3 and a spraying nozzle 4, which have a function of spraying the content of the can, are also attached to the can body 2.

Since propellant, which is used to spray the content of an aerosol can, is enclosed in the can, the inside of the can is in a state of high pressure. Therefore, it is necessary that the bottom of the can have a sufficiently high resistance to pressure in order to withstand the internal pressure.

Techniques described below have been disclosed as techniques regarding a steel sheet to be used for a can of which a high resistance to pressure is required as is the case with an aerosol can.

Patent Literature 1 discloses a material steel sheet with surface treatment to be used for a DI can having high resistance to pressure and necking formability and a method for manufacturing the steel sheet. It is disclosed that the steel has a chemical composition containing, by mass %, C: 0.0100% to 0.0900%, Mn: 0.05% to 1.00%, P: 0.030% or less, S: 0.025% or less, sol.Al: 0.010% to 0.100%, N: 0.0005% to 0.0120%, and the balance being iron and inevitable impurities, that the material steel sheet has a grain size number (hereinafter, called G.Sno) of 9.5 or more, Hv (10% BH) of 145 or more, and Hv (70% BH) of 195 or less, that an annealed sheet having a G.Sno of 9.5 or more and an axis ratio of 1.4 or less is made by the steel having the chemical composition described above being subjected to hot rolling under a condition of CT: 660° C. to 750° C., cold rolling under a condition of a rolling reduction ratio of 84% to 91%, and box annealing under a condition of an annealing temperature: recrystallization temperature to 700° C. and that Hv (10% BH) is adjusted to be 145 or more and Hv (70% BH) is adjusted to be 195 or less by performing temper rolling on the annealed sheet under a condition of an elongation of 2% or more and 30% or less.

Patent Literature 2 discloses a steel sheet to be used for a DI can having a high resistance to pressure and necking formability and a method for manufacturing the steel sheet. It is disclosed that the steel sheet is a steel sheet to be used for a DI can having a chemical composition containing, by mass %, C: 0.01% to 0.08%, Mn: 0.5% or less, Sol.Al: 0.20% or less, and N: 0.01% or less, and, further as needed, containing one or more of S, Cr, Cu, and Ni: 0.1% or less and/or one or more of Ti and Nb: 0.1% or less, in which the content of solid solute C is adjusted to be 5 ppm to 25 ppm, in which the YP in the L direction is adjusted to be 30 $Kgf/mm^2$ to 44 $Kgf/mm^2$, and in which the difference in YP between the L and C directions is adjusted to be 2 $Kgf/mm^2$ or less and that the method includes cold-rolling a hot-rolled sheet having the chemical composition described above, performing a recrystallization treatment, cooling the sheet at a cooling rate of 60° C./s or more, holding the sheet at a temperature of 300° C. to 450° C. for a duration of 30 seconds to 180 seconds, and performing wet temper rolling under a condition of a rolling reduction ratio of 3% to 12%.

Patent Literature 3 discloses a steel sheet to be used for a DI can having a low incidence of occurrence of cracks when a flange is formed and providing a can with high strength as a result of hybridization of a microstructure having crystal grains of a large size, which is advantageous for formability, and a microstructure having crystal grains of a small size, which is hard and has high grain boundary strength, and a method for manufacturing the steel sheet. The steel sheet to be used for a DI can according to Patent Literature 3 has a chemical composition containing, by mass %, C: 0.01% to 0.08%, Al: 0.03% to 0.12%, and N: 0.001% to 0.008% and a dual-phase microstructure classified in terms of grain size number according to JIS in the cross-sectional direction of a product sheet, one phase having a small grain size of #11.5 or more expressed as a grain size number and constituting portions of 5% to 25% in the thickness from the front and back sides, another phase having a large grain size of less than #11.0 expressed as a grain size number and constituting the remainder in the middle in the thickness direction. The disclosed method for manufacturing the steel sheet includes using a continuously cast slab as a material, heating the material so that the temperature of the surface layer portion is higher by 20° C. or more in comparison to that of the central part and the surface temperature is 1000° C. to 1200° C. and then performing hot rolling.

Patent Literature 4 discloses a steel sheet with both of good resistance to deformation of a can made of an ultra-thin steel sheet for can and good can formability and a method for manufacturing the steel sheet. The disclosed method includes cold-rolling steel having a chemical composition containing, by mass %, C: 0.0800% or less, N: 0.0600% or less, Si: 2.0% or less, Mn: 2.0% or less, P: 0.10% or less, S: 0.05% or less, Al: 2.0% or less, and the balance mainly including Fe, adjusting, for example, an atmosphere, a temperature, and a duration of a recrystallization annealing or a heat treatment thereafter and performing an appropriate surface treatment prior to the heat treatment so that change in N content in the steel, in particular, N content and hardness of the surface layer portions and the central layer portion, and further, of some part viewed from the surface of the steel sheet, are controlled respectively to values within different appropriate ranges.

Patent Literature 5 discloses a steel sheet with both of good resistance to deformation of a can made of an ultra-thin can steel sheet and good can formability and a method for manufacturing the steel sheet. The disclosed method relates to a steel sheet to be used for a two-piece can, and the method includes hot-rolling, using a common method, a continuously cast slab having a chemical composition containing, by mass %, C: 0.02% to 0.08%, Si: 0.02% or less, Mn: 0.05% to 0.30%, P: 0.025% or less, S: 0.025% or less, N: 0.003% to 0.02%, Al: 0.02% to 0.15%, and the balance being Fe and inevitable impurities, coiling at a temperature of 570° C. to 670° C., in which content of (Ntotal−NasAlN) is 0.003 to 0.010 mass %.

Patent Literature

[PTL 1] Japanese Unexamined Patent Application Publication No. 7-278744

[PTL 2] Japanese Unexamined Patent Application Publication No. 8-311609

[PTL 3] Japanese Unexamined Patent Application Publication No. 10-17993

[PTL 4] Japanese Unexamined Patent Application Publication No. 2004-323906

[PTL 5] Japanese Unexamined Patent Application Publication No. 4-350146

SUMMARY OF THE INVENTION

Patent Literature 1 discloses a technique in which good resistance to pressure is achieved by specifying Hv (10% BH), which is a Hv value observed after a prestrain due to additional rolling under a condition of an elongation of 10% has been given and BH heat treatment that is a heat treatment under conditions of a temperature of 210° C. and for a duration of 5 minutes has been performed. In the case of a DI can, it is appropriate to evaluate the properties of a steel sheet using the method described above, because heating at a temperature of 210° C. for a duration of about 5 minutes for lacquer baking after forming of a bottom equivalent to the additional rolling under a condition of an elongation of 10% has been performed. However, since, in the case of the aerosol can illustrated in FIG. 1, forming of a bottom is performed after lacquering and baking have been performed, it is not able to evaluate the properties using the method described above. In addition, since the technique according to Patent Literature 1 uses box annealing to produce the steel sheet, there are problems in this annealing method in uniformity of material quality of the product and productivity.

Patent Literature 2 discloses a technique in which certain mechanical properties are achieved by specifying the content of solid solute C and controlling bake hardening property and performing wet temper rolling under a condition of a rolling reduction ratio of 3% to 12%. However, this technique is not preferable, because an increase in strength due to bake hardening cannot be expected in the case of an aerosol can as described above, because temper rolling under a condition of a rolling reduction ratio of 3% to 12% causes a decrease in productivity due to switching of operation conditions between wet and dry methods in the case where a temper rolling apparatus is attached to an annealing line, and because an increase in number of processes causes an increase in cost in the case where a temper rolling apparatus is separated from an annealing line.

Patent Literature 3 discloses a steel sheet having two kinds of layers, in which the grain size number according to JIS of the surface layers on the front and back sides is different from that of the internal layer in the cross section direction of the product sheet, in which there is a problem in industrial productivity because it is necessary to strictly control the temperatures of the surface layers and the internal layer of a continuously cast slab having large variable factors.

Patent Literature 4 relates to a steel sheet with both the resistance to deformation of a can and can formability in which N content and hardness are controlled in the surface and internal layers of the steel sheet. However, since recrystallization annealing in a nitriding atmosphere is necessary, there is a problem in industrial productivity.

Patent Literature 5 discloses a technique in which continuously cast aluminum killed steel into which a large amount of N is added is used intending to increase the strength of steel by a large amount of solid solute N retained. For this purpose, the amount of N in steel is increased in order to compensate for a decrease in the amount of solid solute N due to coiling at a medium temperature after hot rolling has been performed. However, since the amount of retained solid solute N is small in comparison to the amount of N in steel in this technique, it is necessary to add excessive amount of N in comparison to required amount of solid solute N, which is not reasonable.

Although, as described above, techniques focusing on the bottom part of a DI can have been proposed regarding an increase in resistance to pressure, there has been no technique for increasing resistance to pressure regarding a material to be used for the bottom of an aerosol can which is manufactured under forming and heat treatment conditions different from those for a DI can.

It is effective to increase the strength of a steel sheet in order to increase resistance to pressure. In addition, resistance to pressure is influenced by the shape of a bottom, and it is necessary that a bottom structure has a shape bulging into the inside of a can. Therefore, a steel sheet is required to have formability to be formed into such shape.

The present invention has been completed in view of the situation described above, and it provides a steel sheet to be used for the bottom of an aerosol can having high resistance to pressure and high formability and a method for manufacturing the steel sheet.

The present inventors conducted investigations regarding influences of the mechanical properties and thickness of a steel sheet on the resistance to pressure and formability of the bottom of an aerosol can, and, as a result, found that required resistance to pressure and formability are both achieved by balancing the mechanical properties and thickness under specified conditions. That is to say, it was found that a steel sheet having high formability and high resistance to pressure could be achieved by appropriately controlling a thickness and mechanical properties, in particular, a yield point and age hardening behavior at room temperature.

In addition, it was also found that, in the case where a thickness is specified in consideration of economic efficiency, it is advantageous to use steel having higher N content than usual, to control the contents of Al, Mn, S, and N so that a specified relationship is satisfied and to specify manufacturing conditions such as a heating temperature of a slab and a coiling temperature of hot rolling in order to achieve the mechanical properties satisfying the specified conditions described above.

The present invention has been completed on the basis of the knowledge described above, and the subject matter of the present invention includes the following embodiments.

[1] A steel sheet for the bottom of aerosol cans with high resistance to pressure and high formability, the steel sheet having a chemical composition containing, by mass %, C: 0.02% or more and 0.10% or less, Si: 0.01% or more and 0.5% or less, P: 0.001% or more and 0.100% or less, S:

0.001% or more and 0.020% or less, N: 0.007% or more and 0.025% or less, Al: 0.01% or more and {−4.2×N (%)+0.11}% or less, Mnf: 0.100 or more and less than 0.30% where Mnf is defined by equation Mnf=Mn−1.71×S (where Mn and S in the equation respectively denote the contents (mass %) of Mn and S in the steel), and the balance being Fe and inevitable impurities, in which the steel sheet has a thickness of 0.35 mm or less, the product of the lower yield point ($N/mm^2$) of the steel sheet and the thickness (mm) is 160 (N/mm) or less, and the product of the upper yield point ($N/mm^2$) of the steel sheet which is observed after performing an aging treatment at room temperature under conditions of a temperature of 25° C. and a duration of 10 days after giving a tensile prestrain of 10% to the steel sheet and the square of the thickness (mm) is 52.0 (N) or more.

[2] The steel sheet for the bottom of aerosol cans with high resistance to pressure and high formability according to item [1], in which the steel sheet has the chemical composition containing, by mass %, Al: 0.01% or more and {−4.2×N (%)+0.11}% or less and {3.0×N (%)}% or less, and Nf is 0.65 or more where Nf is defined by equation Nf={N−N as AlN}/N (where N in the equation denotes the N content (mass %) in the steel and N as AlN denotes the content (mass %) of N which is present in the steel in the form of AlN).

[3] A method for manufacturing a steel sheet for the bottom of aerosol cans with high resistance to pressure and high formability, the method including producing molten steel having a chemical composition containing, by mass %, C: 0.02% or more and 0.10% or less, Si: 0.01% or more and 0.5% or less, P: 0.001% or more and 0.100% or less, S: 0.001% or more and 0.020% or less, N: 0.007% or more and 0.025% or less, Al: 0.01% or more and {−4.2×N (%)+0.11}% or less, Mnf is 0.10% or more and less than 0.30% where Mnf is defined by equation Mnf=Mn−1.71×S (where Mn and S in the equation respectively denote the contents (mass %) of Mn and S in the steel), and the balance being Fe and inevitable impurities, casting the steel into a slab using a continuous casting method, reheating the slab up to a temperature of 1150° C. or higher, then hot-rolling the slab under a condition of a coiling temperature of lower than 620° C., performing pickling, cold-rolling and then recrystallization annealing, and performing temper rolling under a condition of an elongation of less than 3%.

[4] The method for manufacturing a steel sheet for the bottom of aerosol cans with high resistance to pressure and high formability according to item [3], in which the steel sheet has the chemical composition containing, by mass %, Al: 0.01% or more and {−4.2×N (%)+0.11}% or less and {3.0×N (%)}% or less, and Nf is 0.65 or more where Nf is defined by equation Nf={N−N as AlN}/N (where N in the equation denotes the N content (mass %) in the steel and N as AlN denotes the content (mass %) of N which is present in the steel in the form of AlN).

Note that % used when describing a chemical composition always represents mass % in the present invention.

According to the present invention, a steel sheet for the bottom of aerosol cans with high resistance to pressure and high formability can be achieved.

BRIEF DESCRIPTION OF THE DRAWING

FIG. 1 is a diagram illustrating the structure of an aerosol can fitted with a bottom which is made from the steel sheet according to an embodiment of the present invention.

DESCRIPTION OF EMBODIMENTS OF THE INVENTION

The present invention according to exemplary embodiments will be described in detail hereafter.

Firstly, a chemical composition will be described. The chemical composition will always be described in units of mass %.

C: 0.02% or more and 0.10% or less

The steel sheet according to the present invention is typically a steel sheet which is manufactured through processes of continuous casting, hot rolling, pickling, cold rolling recrystallization annealing, and temper rolling. Moreover, it is advantageous that the steel sheet have the mechanical properties described below. An added amount of C as a solid-solution strengthening element is preferred in the case of the steel sheet required such properties, and the lower limit of the C content is set to be 0.02%. In the case where the C content is less than 0.02%, the mechanical properties specified in the present invention cannot be achieved. On the other hand, in the case where the C content is more than 0.10%, the hardness becomes excessively high, and, moreover, a pearlite phase described below tends to be formed. In addition, a crack tends to occur in the solidification process of a continuously cast slab. Therefore, the upper limit of the C content is set to be 0.10%. Preferably, the C content is 0.03% or more and 0.07% or less.

Si: 0.01% or more and 0.5% or less

Si is a chemical element which increases the strength of steel through solid-solution strengthening. It is preferred that the Si content be 0.01% or more in order to realize this effect. On the other hand, in the case where the Si content is large, there is a significant decrease in corrosion resistance. Therefore, the Si content is set to be 0.01% or more and 0.5% or less.

P: 0.001% or more and 0.100% or less

P is a chemical element which is significantly effective for increasing the strength of steel through solid-solution strengthening. However, in the case where the P content is large, there is a significant decrease in corrosion resistance. Therefore, the upper limit of the P content is set to be 0.100%. On the other hand, the dephosphorization cost becomes excessively high in order to control the P content to be less than 0.001%. Therefore, the lower limit of the P content is set to be 0.001%

S: 0.001% or more and 0.020% or less

S is a kind of impurity brought in from materials fed into a blast furnace and forms MnS in combination with Mn in steel. Since MnS is precipitated at grain boundaries at a high temperature, which results in embrittlement, the upper limit of the S content is set to be 0.020%. On the other hand, the desulfurization cost becomes excessively high in order to control the S content to be less than 0.001%. Therefore, the lower limit of the S content is set to be 0.001%

N: 0.007% or more and 0.025% or less

N is a chemical element which contributes to solid-solution strengthening and hardening due to strain aging described below. It is preferred that the N content be 0.007% or more in order to realize these effects. On the other hand, since, in the case where the N content is large, effect of hardening due to strain aging is saturated, the advantageous effects of N are not realized, and, moreover, there is a decrease in ductility at a high temperature. Therefore, the upper limit of the N content is set to be 0.025%.

Al: 0.01% or more and {−4.2×N (%)+0.11}% or less, preferably 0.01% or more and {−4.2×N (%)+0.11}% or less and {3.0×N (%)}% or less Since Al functions as a deoxidation agent, Al is a chemical element which is advantageous for increasing the cleanliness of steel. In addition, solid solute N is utilized in order to achieve specified mechanical properties in the present invention. On the other hand, Al forms AlN in combination with N in steel. Therefore, since it is preferred that excessive precipitation of AlN be suppressed, it is preferred that the upper limit of the Al content be specified. The amount of precipitated AlN is determined depending on the Al content, the N content, a thermal history in the processes of solidification of a slab to reheating of a slab and a thermal history in the coiling process of hot rolling. From the results of investigations regarding conditions for suppressing the precipitation of AlN in combination with the manufacturing conditions described below, the upper limit of the Al content is set to be {−4.2×N (%)+0.11}% in relation to the N content. Preferably, the upper limit is {3.0×N (%)}% in addition to {−4.2×N (%)+0.11}%. By setting the upper limit to be {−4.2×N (%)+0.11}%, the amount of solid solute N can be secured by promoting solution of AlN which is formed at the slab stage. In addition, by setting the upper limit to be {3.0×N (%)}%, the amount of solid solute N can be secured by avoiding precipitation of AlN at the hot rolling stage. By setting the upper limit of the Al content to be {−4.2×N (%)+0.11}% and {3.0×N (%)}% as described above, and in combination with the manufacturing conditions described below, Nf, that is, a ratio of the amount of solid solute N to the added N content, which is used to specify a preferable condition in the present invention, can be increased. As a result, the amount of solid solute N, which effectively acts in hardening due to strain aging when forming of a bottom and an aging treatment at room temperature are performed, can be secured.

On the other hand, since deoxidization cannot be sufficiently performed in the case of steel having an Al content of less than 0.01%, which results in a decrease in the cleanliness of steel, the lower limit of the Al content is set to be 0.01%. Note that Al in the present invention is acid-soluble Al.

Mnf: 0.10% or more and less than 0.30%, where Mnf is defined by equation Mnf=Mn−1.71×S where Mn and S in the equation respectively denote the contents (mass %) of Mn and S in steel Mn increases the strength of steel through solid-solution strengthening and by making the grain size small. However, since Mn forms MnS in combination with S, the amount of Mn which contributes to solid-solution strengthening is considered to be the amount derived by subtracting the amount of Mn which is able to form MnS from the Mn content. In consideration of the ratio of Mn to S in atomic weight, the amount of Mn which contributes to solid-solution strengthening can be represented by Mnf=Mn−1.71×S. In the case where Mnf is 0.30% or more, there is a significant effect of making the grain size small, which results in excessive hardening. Therefore, Mnf is set to be less than 0.30%. On the other hand, in the case where Mnf is less than 0.10%, the required strength cannot be achieved due to softening. Therefore, Mnf is set to be 0.10% or more.

Nf: 0.65 or more (preferable condition), where Nf is defined by equation Nf={N−N as AlN}/N where N in the equation denotes the N content (mass %) in the steel and N as AlN denotes the content (mass %) of N which is present in the steel in the form of AlN Since the present invention utilizes the occurrence of hardening due to strain aging, it is advantageous that large amount of N which forms a solid solution be included in the N content in steel. A steel sheet to be used for the bottom of an aerosol can having higher resistance to pressure and higher formability can be achieved by securing solid solute N in an amount of 0.65 or more in terms of Nf which is an indicator of the ratio of the amount of solid solute N to the N content in steel. Note that N as AlN can be observed using a 10%-Br methanol extraction method.

The remainder of the chemical composition consists of Fe and inevitable impurities.

In addition, it is desirable that the steel sheet according to the present invention have a microstructure which does not include a pearlite structure. Since a pearlite structure is a structure in which a ferrite phase and a cementite phase are precipitated lamellarly, there is concern that, in the case where a coarse pearlite structure is present, it may become an origin of a crack due to stress concentration when steel is subjected to deformation. It is possible that, when the bottom of an aerosol can is attached to a can body by seaming, a crack occurs in a portion to be seamed in the case where there is such an origin of a crack described above.

Next, the relationship between a thickness and mechanical properties of the steel sheet according to the present invention will be described below.

It is preferred to balance the thickness and mechanical properties of a steel sheet so that a specified relationship is satisfied in order to realize a steel sheet that is to be used for the bottom of an aerosol can having high resistance to pressure and high formability. In particular, it is preferred to limit the hardening behavior of a steel sheet due to strain aging at room temperature in order to achieve high resistance to pressure.

The bottom of an aerosol can (hereinafter, also simply called "bottom") is formed so as to bulge into the inside of a can in order to have a structure which can withstand the internal pressure of the can. Strain is given to the steel sheet by performing this forming operation. The strength of a steel sheet is increased by giving strain to the steel sheet, which contributes to an increase in the resistance to pressure of the bottom of an aerosol can. However, a very high degree of working is necessary in order to increase resistance to pressure to a required level only by controlling strain. On the other hand, it is necessary that the steel sheet be soft in order to realize a high degree of working. However, this results in a decrease in resistance to pressure. The present inventors focused on hardening due to strain aging in order to overcome the contradiction described above. That is to say, the hardness of a steel sheet is increased through the use of aging after giving strain to the steel sheet by performing some degree of working.

Generally, hardening due to strain aging of a steel sheet is realized by intentionally performing a heat treatment. For example, lacquer baking is performed after the forming operation has been performed. Therefore, the hardening behavior due to strain aging of a steel sheet is evaluated using a method in which, after a specified forming operation has been performed, an intentional heat treatment, simulating lacquer baking, is performed under conditions of a temperature of about 170° C. to 220° C. and a duration of several minutes to several tens of minutes.

On the other hand, a heat treatment which is performed after a forming operation has been performed in a manufacturing process of the bottom of an aerosol can is performed under conditions of a temperature of several tens of degrees and a duration of several minutes in order to dry the sealing compound, which is a very minor treatment. Moreover, the bottom of an aerosol can is used in practice after being held at room temperature rather than immediately after being formed. That is to say, in the case of the bottom of an aerosol can, aging at room temperature is the main aging process employed.

Therefore, as far as a method for evaluating the hardening behavior due to strain aging of a steel sheet to be used for the bottom of an aerosol can is concerned, a conventional method, which is performed under conditions of a comparatively high temperature and a comparatively long duration, is not appropriate, because the thermal history of the method has excessive effects on the steel sheet. From the investigation results described above, the present inventors focused on strain aging at room temperature as an indicator of the hardening behavior due to strain aging in reference to the aging behavior, through the processes in which the bottom of an aerosol can is formed and used in practice, and practical resistance to pressure in use. Specifically, a yield point of the steel sheet which is observed after performing an aging treatment at room temperature under conditions of a temperature of 25° C. and a duration of 10 days after giving a tensile prestrain of 10% to the steel sheet is used as an indicator of the hardening behavior due to strain aging.

Here, a tensile prestrain of 10% is given to the steel sheet in order to simulate the strain due to forming of a bottom. The present inventors investigated degree of working by practically forming the bottoms of various aerosol cans in order to determine the conditions of this simulation. Firstly, lines were drawn for marking in a circular plate, which is a material of a bottom, through the center of the circular plate at intervals of 15° in the circumferential direction and plural concentric circles were drawn for marking at intervals of 5 mm in the radial direction, and then a bottom was practically formed using the circular plate. After the forming of the bottom, strains due to forming in the radial and circumferential directions of the bottom were calculated at each position based on the marked drawn lines. In addition, a strain in the thickness direction was calculated from the above two strains on the basis of constant volume condition. As a result, it was found that the highest degree of working is about 0.1 in terms of equivalent strain in the bottoms of various aerosol cans. An equivalent strain of 0.1 is equivalent to an elongation of 10% in uniaxial tensile forming. From this result, a tensile prestrain of 10% is utilized as a forming simulating the strain due to forming of a bottom. Incidentally, the tensile forming according to the present invention may be conducted according to JIS Z 2241 "Metallic materials-Tensile testing-Method of test at room temperature" using a No. 5 tensile test piece according to JIS Z 2201 "Test pieces for tensile test for metallic materials". An elongation of 10% is determined using an elongation observed on the basis of a gauge length of 50 mm. In addition, the tensile direction in the tensile tests is set to be in the rolling direction of a steel sheet. That is because, generally, the yield point of a steel sheet has the lowest value in the rolling direction and because the lower limit of resistance to pressure is given by considering the direction in which a yield point has the lowest value in investigations on the resistance to pressure of the bottom of an aerosol can.

The conditions of an aging temperature of 25° C. and an aging time of 10 days according to the present invention were determined on the basis of conditions in which a practical bottom is used. That is to say, a bottom is held for a certain period after the forming, and then used. From the results of the investigations on conditions in which a bottom is held and used, the conditions of an average temperature of 25° C. and an average duration of 10 days were found. Thus, the aging temperature and the aging time were set on the conditions described above.

In addition, an upper yield point is used as a yield point in this evaluation. This is based on the knowledge that the resistance to pressure of a bottom is represented by higher correlation coefficient with an upper yield point rather than with a lower yield point.

Although resistance to pressure increases, as described above, with an increase in an upper yield point after a strain aging treatment at room temperature has been performed, resistance to pressure is also influenced by a thickness of the sheet other than an upper yield point. From the results of the experiments conducted by the present inventors, it was found that the square of a thickness has an influence on resistance to pressure. Therefore, according to the present invention, the product of an upper yield point after a strain aging treatment at room temperature and the square of a thickness is to be specified. Specifically, the product of an upper yield point after a strain aging treatment at room temperature and the square of a thickness is set to be 52.0 N or more as a condition in which resistance to pressure of a can of a nominal diameter of 211 (about 2 and 11/16 inches), which is the largest among diameters of the bottoms of practical aerosol cans, becomes 1.65 MPa or more. Note that, since resistance to pressure increases with a reduction in the diameter of a bottom in the case where the same material is used for a bottom, resistance to pressure is sufficient even in the case where the evaluation indicator described above is used for a bottom of a diameter less than a nominal diameter of 211.

According to the discussions above, it may be concluded that it is preferable that the thickness of a steel sheet to be used for the bottom of an aerosol be as thick as possible and the strength of the steel sheet be as high as possible. However, excessive thickness and strength of the steel sheet cause a decrease in formability of a bottom. Specifically, these cause such problems that, for example, a bottom cannot be formed into a specified shape and the wear or damage of forming tools frequently occurs in the process of forming a bottom. This is because excessive thickness and strength of a steel sheet cause an increase in the resistance to deformation of the steel sheet, which results in high load on forming tools. Therefore, it is necessary to appropriately specify the thickness and strength from the viewpoint of formability in order to avoid these problems.

Resistance to deformation in the forming of a bottom varies depending on the thickness and strength of a steel sheet and the size of a bottom. The strength of a steel sheet is influenced by the lower yield point of the steel sheet before the forming of a bottom. This is thought to be because the degree of working in the forming of a bottom is equivalent to or more than a strain at which an upper yield point appears. In addition, it is necessary to consider a thickness of the sheet and a diameter of a bottom in addition to a lower yield point in order to investigate resistance to deformation. That is to say, the product of a lower yield point, a thickness, and the diameter of a bottom is an indicator having a relationship with resistance to deformation. In the present invention, the product of the thickness and lower yield point of a steel sheet before the forming of a bottom is preferably set to be 160 N/mm or less as an indicator of considering the diameter of the bottom in advance, which is a condition under which the negative effect described above can be suppressed within an acceptable range even in the practical forming of a can of a nominal diameter of 211, which is the largest among diameters of the bottoms of practical aerosol cans.

Note that, since resistance to deformation decreases with a reduction in the diameter of a bottom in the case where the same material is used for a bottom, resistance to deformation is not excessive even in the case where the evaluation indicator described above is used for a bottom of a diameter less than a nominal diameter of 211.

On the other hand, it is also necessary to design the bottom of an aerosol can in consideration of economic efficiency in addition to resistance to pressure and formability described above. That is to say, an excessive thickness causes an increase in the cost of a steel sheet which is a material of a bottom. From this point of view, the thickness of a steel sheet is set to be 0.35 mm or less.

Next, the method for manufacturing a steel sheet for the bottom of aerosol cans with high resistance to pressure and high formability according to an aspect of the present invention will be described below.

The steel sheet according to the present invention is typically manufactured through the processes of continuous casting, hot rolling, pickling, cold rolling, recrystallization annealing, and temper rolling, and, further as needed, surface treatment. The method will be described in detail hereafter.

Steel having the chemical composition described above is produced by steelmaking and made into a slab through use of a continuous casting method. It is preferable that, when a slab is cast through use of an continuous casting machine of a vertical bending or curved type, the surface temperature of the corner portions of the slab in a zone where the slab is subjected to deformation due to bending or unbending be 800° C. or lower or 900° C. or higher. The occurrence of a crack in corner portions between long and short sides in the cross-section of a slab can be avoided by this method.

The continuously cast slab is subjected to reheating at a temperature of 1150° C. or higher. AlN which is precipitated in the process of cooling of the slab can be resolved by reheating the slab at a temperature of 1150° C. or higher.

Subsequently, the slab is subjected to hot rolling. Here, it is preferable that finishing temperature of hot rolling be equal to or higher than the $Ar_3$ point. A coiling temperature is set to be lower than 620° C. In the case where the coiling temperature after the finish rolling is 620° C. or higher, AlN is precipitated, which reduces the effect of N according to the present invention. In addition, it is preferable that the coiling temperature be 540° C. or higher in order to avoid an excessive increase in hardness.

After hot rolling has been performed, the cooled hot-rolled strip is subjected to pickling for descaling. Pickling may be performed through use of a common method such as one using sulfuric acid or hydrochloric acid.

Subsequently, cold rolling is performed. It is preferable that cold rolling be performed under a condition of a rolling reduction ratio of 80% or more. This is done for the purpose of crushing a pearlite structure which is formed after the hot rolling has been performed. It is possible that a pearlite structure is retained in the case where the cold rolling reduction ratio is less than 80%. It is preferable that the upper limit of the rolling reduction ratio be 95% in order to avoid an increase in load on a rolling mill due to an excessive rolling reduction ratio and negative effects on rolling results due to increase in load.

After cold rolling has been performed, recrystallization annealing is performed. It is preferable that recrystallization annealing be performed using a continuous annealing method. In the case of box annealing, solid solute N is precipitated as AlN and hardening due to strain aging at room temperature, which is advantageous in the present invention, might not be achieved in some cases. In addition, it is preferable that an annealing temperature be lower than the $A_1$ transformation point. That is because, since an austenite phase is formed during annealing in the case where an annealing temperature is equal to or higher than the $A_1$ transformation point, there is a case where a pearlite structure is formed which may become an origin of a crack when forming of a bottom is performed.

After annealing has been performed, temper rolling is performed under a condition of an elongation of less than 3%. Temper rolling is performed in order to provide the surface of a steel sheet with specified mechanical properties and surface roughness. Here, since there is an excessive increase in the hardness of a steel sheet due to work hardening in the case where the elongation is 3% or more, the elongation is set to be less than 3%.

The steel sheet manufactured as described above is used as a material sheet to be subjected to surface treatment. There is no limitation on the kind of a surface treatment, because the effect of the present invention is not influenced by the kind of a surface treatment. Examples of typical methods for a surface treatment of a can include a coating treatment with metal such as tin plating (tin plate) and chromium plating (tin free steel), metal oxide, metal hydroxide, mineral salts, or the like, and an additional coating treatment thereon with an organic resin film such as a laminate treatment. Since there is a case where a steel sheet is subjected to a heating treatment in these surface treatments, there is an aging effect to the steel sheet. In addition, during a steel sheet being held before the steel sheet is formed into a bottom, there is also an aging effect in accordance with a holding temperature and holding time. Moreover, there is also an aging effect when the steel sheet is subjected to lacquering. However, it has been confirmed that the effects of the present invention are not influenced by these aging effects to which a steel sheet in the material sheet stage is subjected.

The steel sheet to be used for the bottom of an aerosol can having high resistance to pressure and high formability according to the present invention is manufactured by the method described above.

Examples

Examples will be described hereafter.

Steels having the chemical compositions given in Table 1 were produced by steelmaking and subjected to hot rolling, cold rolling, recrystallization annealing, and temper rolling under conditions given in Table 2.

Then, the steel sheets marked with symbols a1, a2, d1, d2, f1, f2, i1, j1, j2, k1, k2, l1, l2, and l3 given in Table 2 were subjected to chromium plating as a surface treatment to be tin-free steel sheets, and, further, made into laminated steel sheets by being laminated with a PET film. The steel sheets given in Table 2 other than those described above were made into tin plates by being subjected to tin plating as a surface treatment, and, further, subjected to lacquering and a baking treatment.

Tensile test was conducted according to JIS Z 2241 "Metallic materials-Tensile testing-Method of test at room temperature" using a No. 5 tensile test piece according to JIS Z 2201 "Test pieces for tensile test for metallic materials" cut out from each of the steel sheets obtained as described above, and a lower yield point (YP) was observed. In addition, an upper yield point (YP*) was observed after performing an aging treatment at room temperature under conditions of a temperature of 25° C. and a duration of 10 days after giving a tensile prestrain of 10% to the steel sheet. Then, on the basis of the observation results of the lower yield point (YP) and the upper yield point (YP*), the product (t·YP) of the lower yield point ($N/mm^2$) and the thickness (mm) and the product ($t^2$·YP*) of the upper yield point ($N/mm^2$) which was observed after performing an aging treatment at room temperature under conditions of a temperature of 25° C. and a duration of 10 days after a tensile prestrain of 10% was given and the square of the thickness (mm) were calculated. The obtained results are given in Table 3.

Note that the calculated results of the specifications (including the preferable condition) according to the present invention regarding a chemical composition, the calculated results of {−4.2×N (%)+0.11}, {3.0×N (%)} and Mnf=Mn−1.71×S are given in Table 1, and the calculated results of Nf={N−N as AlN}/N are given in Table 3.

TABLE 1

| | mass % | | | | | | | | | |
|---|---|---|---|---|---|---|---|---|---|---|
| Steel | C | Si | Mn | P | S | Al | N | Mnf | −4.2 × N + 0.11 | 3.0 × N |
| a | 0.046 | 0.01 | 0.21 | 0.010 | 0.013 | 0.048 | 0.0080 | 0.19 | 0.076 | 0.024 |
| a' | 0.046 | 0.01 | 0.21 | 0.010 | 0.013 | 0.020 | 0.0080 | 0.19 | 0.076 | 0.024 |
| b | 0.076 | 0.01 | 0.17 | 0.016 | 0.010 | 0.025 | 0.0121 | 0.15 | 0.059 | 0.036 |
| b' | 0.076 | 0.01 | 0.17 | 0.016 | 0.010 | 0.055 | 0.0125 | 0.15 | 0.058 | 0.038 |
| c | 0.042 | 0.01 | 0.26 | 0.015 | 0.011 | 0.036 | 0.0148 | 0.24 | 0.048 | 0.044 |
| c' | 0.042 | 0.01 | 0.26 | 0.015 | 0.011 | 0.047 | 0.0147 | 0.24 | 0.048 | 0.044 |
| d | 0.040 | 0.01 | 0.24 | 0.014 | 0.011 | 0.015 | 0.0185 | 0.22 | 0.032 | 0.056 |
| e | 0.014 | 0.02 | 0.30 | 0.011 | 0.012 | 0.089 | 0.0021 | 0.28 | 0.101 | 0.006 |
| f | 0.043 | 0.01 | 0.25 | 0.012 | 0.013 | 0.054 | 0.0027 | 0.22 | 0.099 | 0.008 |
| g | 0.069 | 0.01 | 0.53 | 0.016 | 0.018 | 0.065 | 0.0040 | 0.50 | 0.093 | 0.012 |
| h | 0.117 | 0.01 | 0.28 | 0.014 | 0.006 | 0.032 | 0.0030 | 0.27 | 0.097 | 0.009 |
| i | 0.071 | 0.01 | 0.47 | 0.016 | 0.019 | 0.076 | 0.0119 | 0.44 | 0.060 | 0.036 |
| j | 0.043 | 0.01 | 0.22 | 0.013 | 0.013 | 0.033 | 0.0148 | 0.20 | 0.048 | 0.044 |
| k | 0.037 | 0.01 | 0.24 | 0.008 | 0.013 | 0.021 | 0.0188 | 0.22 | 0.031 | 0.056 |
| l | 0.042 | 0.02 | 0.24 | 0.015 | 0.010 | 0.040 | 0.0143 | 0.22 | 0.050 | 0.043 |
| m | 0.071 | 0.01 | 0.31 | 0.016 | 0.019 | 0.031 | 0.0119 | 0.28 | 0.060 | 0.036 |
| n | 0.054 | 0.01 | 0.25 | 0.015 | 0.011 | 0.025 | 0.0088 | 0.23 | 0.073 | 0.026 |

TABLE 2

| No | Symbol | Steel | Slab Heating Temperature ° C. | Finishing Temperature ° C. | Coiling Temperature ° C. | Cold Rolling Reduction Ratio % | Recrystallization Annealing Temperature ° C. | Elongation % |
|---|---|---|---|---|---|---|---|---|
| 1 | a1 | a | 1200 | 860 | 540 | 88 | 670 | 1.0 |
| 2 | a2 | a | 1100 | 860 | 540 | 85 | 670 | 1.0 |
| 3 | a3 | a' | 1200 | 860 | 540 | 88 | 670 | 1.0 |
| 4 | b1 | b | 1200 | 860 | 540 | 85 | 670 | 1.0 |
| 5 | b2 | b' | 1200 | 860 | 540 | 85 | 670 | 1.0 |
| 6 | c1 | c | 1230 | 860 | 560 | 85 | 670 | 1.0 |
| 7 | c2 | c | 1230 | 860 | 680 | 85 | 670 | 1.0 |
| 8 | c3 | c' | 1230 | 860 | 560 | 85 | 670 | 1.0 |
| 9 | d1 | d | 1200 | 860 | 560 | 85 | 670 | 1.0 |
| 10 | d2 | d | 1200 | 860 | 560 | 85 | 670 | 9.0 |
| 11 | e1 | e | 1230 | 890 | 620 | 85 | 670 | 1.0 |
| 12 | f1 | f | 1200 | 860 | 560 | 88 | 670 | 1.0 |
| 13 | f2 | f | 1200 | 860 | 560 | 85 | 670 | 15.0 |
| 14 | g1 | g | 1200 | 860 | 560 | 88 | 670 | 1.0 |
| 15 | h1 | h | 1200 | 860 | 560 | 85 | 670 | 1.0 |
| 16 | i1 | i | 1200 | 860 | 560 | 85 | 670 | 1.0 |
| 17 | i2 | i | 1130 | 870 | 560 | 85 | 670 | 1.0 |
| 18 | j1 | j | 1130 | 870 | 590 | 85 | 670 | 5.0 |
| 19 | j2 | j | 1200 | 870 | 590 | 85 | 670 | 2.0 |
| 20 | k1 | k | 1200 | 870 | 650 | 85 | 670 | 2.0 |
| 21 | k2 | k | 1200 | 870 | 560 | 85 | 670 | 2.0 |
| 22 | l1 | l | 1210 | 870 | 560 | 85 | 670 | 5.0 |
| 23 | l2 | l | 1210 | 870 | 560 | 86 | 670 | 2.0 |
| 24 | l3 | l | 1130 | 870 | 650 | 86 | 670 | 2.0 |
| 25 | m1 | m | 1200 | 870 | 600 | 84 | 670 | 2.0 |
| 26 | m2 | m | 1200 | 870 | 560 | 84 | 670 | 2.0 |
| 27 | n1 | n | 1195 | 870 | 600 | 84 | 670 | 2.0 |
| 28 | n2 | n | 1195 | 870 | 560 | 84 | 670 | 2.5 |

TABLE 3

| No | Symbol | Steel | Nf | Thickness mm | YP N/mm$^2$ | YP* N/mm$^2$ | t · YP N/mm | t$^2$ · YP* N | Note |
|---|---|---|---|---|---|---|---|---|---|
| 1 | a1 | a | 0.60 | 0.330 | 420 | 485 | 139 | 52.8 | Example |
| 2 | a2 | a | 0.60 | 0.330 | 405 | 456 | 134 | 49.7 | Comparative Example |
| 3 | a3 | a' | 0.95 | 0.330 | 415 | 495 | 137 | 53.8 | Example |
| 4 | b1 | b | 0.87 | 0.320 | 447 | 520 | 143 | 53.2 | Example |
| 5 | b2 | b' | 0.90 | 0.320 | 438 | 512 | 140 | 52.4 | Example |
| 6 | c1 | c | 0.96 | 0.310 | 460 | 546 | 143 | 52.5 | Example |
| 7 | c2 | c | 0.56 | 0.310 | 444 | 513 | 138 | 49.3 | Comparative Example |
| 8 | c3 | c' | 0.64 | 0.310 | 450 | 545 | 140 | 52.4 | Example |
| 9 | d1 | d | 0.98 | 0.300 | 475 | 584 | 143 | 52.6 | Example |
| 10 | d2 | d | 0.98 | 0.300 | 545 | 600 | 164 | 54.0 | Comparative Example |
| 11 | e1 | e | 0.30 | 0.450 | 360 | 380 | 162 | 77.0 | Comparative Example |
| 12 | f1 | f | 0.44 | 0.340 | 352 | 434 | 120 | 50.2 | Comparative Example |
| 13 | f2 | f | 0.44 | 0.320 | 505 | 530 | 162 | 54.3 | Comparative Example |
| 14 | g1 | g | 0.53 | 0.335 | 375 | 446 | 126 | 50.1 | Comparative Example |
| 15 | h1 | h | 0.46 | 0.330 | 408 | 443 | 135 | 48.2 | Comparative Example |
| 16 | i1 | i | 0.55 | 0.340 | 417 | 445 | 142 | 51.4 | Comparative Example |
| 17 | i2 | i | 0.43 | 0.340 | 415 | 430 | 141 | 49.7 | Comparative Example |
| 18 | j1 | j | 0.43 | 0.340 | 495 | 500 | 168 | 57.8 | Comparative Example |
| 19 | j2 | j | 0.96 | 0.340 | 470 | 515 | 160 | 59.5 | Example |
| 20 | k1 | k | 0.80 | 0.330 | 460 | 475 | 152 | 51.7 | Comparative Example |
| 21 | k2 | k | 0.95 | 0.330 | 475 | 530 | 157 | 57.7 | Example |
| 22 | l1 | l | 0.75 | 0.330 | 490 | 518 | 162 | 56.4 | Comparative Example |
| 23 | l2 | l | 0.75 | 0.330 | 465 | 512 | 153 | 55.8 | Example |
| 24 | l3 | l | 0.60 | 0.330 | 445 | 460 | 147 | 50.1 | Comparative Example |
| 25 | m1 | m | 0.79 | 0.330 | 460 | 528 | 152 | 57.5 | Example |
| 26 | m2 | m | 0.92 | 0.330 | 480 | 520 | 158 | 56.6 | Example |
| 27 | n1 | n | 0.81 | 0.330 | 430 | 480 | 142 | 52.3 | Example |
| 28 | n2 | n | 0.89 | 0.330 | 450 | 490 | 149 | 53.4 | Example |

YP*: Upper yield point (N/mm$^2$) after performing an aging treatment at room temperature under conditions of a temperature of 25° C. and a duration of 10 days after a tensile prestrain of 10% was given As indicated in Table 3, the values of (t·YP) and (t$^2$·YP*) of the examples of the present invention are all within the range according to the present invention, which means steel sheets to be used for the bottom of an aerosol can having high resistance to pressure and high formability are achieved.

REFERENCE SIGNS LIST

1 bottom
2 can body
3 mounting cap
4 spraying nozzle

The invention claimed is:

1. A steel sheet for the bottom of aerosol cans with high resistance to pressure and high formability, the steel sheet having a chemical composition containing, by mass %, C: 0.02% or more and 0.10% or less, Si: 0.01% or more and 0.5% or less, P: 0.001% or more and 0.100% or less, S: 0.001% or more and 0.020% or less, N: 0.007% or more and 0.025% or less, Al: 0.01% or more and {−4.2×N (%)+0.11}% or less and {3.0×N (%)}% or less, and Nf is 0.65 or more where Nf is defined by equation Nf={N−N as AlN}/N, where N in the equation denotes the N content (mass %) in the steel and N as AlN denotes the content (mass %) of N which is present in the steel in the form of AlN, Mnf: 0.10% or more and less than 0.30% where Mnf is defined by equation Mnf=Mn−1.71×S, where Mn and S in the equation respectively denote the contents (mass %) of Mn and S in the steel, and the balance being Fe and inevitable impurities, wherein the steel sheet has a thickness of 0.35 mm or less, has a product of a lower yield point (N/mm$^2$) of the steel sheet and the thickness (mm) that is 160 (N/mm) or less, and has a product of a upper yield point (N/mm$^2$) of the steel sheet which is observed after performing an aging treatment at room temperature under conditions of a temperature of 25° C. and a duration of 10 days after giving a tensile prestrain of 10% to the steel sheet and a square of the thickness (mm) that is 52.0 (N) or more.

2. A method for manufacturing a steel sheet for the bottom of aerosol cans with high resistance to pressure and high formability, the method comprising:

producing molten steel having a chemical composition containing, by mass %, C: 0.02% or more and 0.10% or less, Si: 0.01% or more and 0.5% or less, P: 0.001% or more and 0.100% or less, S: 0.001% or more and 0.020% or less, N: 0.007% or more and 0.025% or less, Al: 0.01% or more and {−4.2×N (%)+0.11}% or less and {3.0×N (%)}% or less, Mnf: 0.10% or more and less than 0.30% where Mnf is defined by equation Mnf=Mn−1.71×S, where Mn and S in the equation respectively denote the contents (mass %) of Mn and S in the steel, and the balance being Fe and inevitable impurities, casting the steel into a slab using a continuous casting method, reheating the slab up to a temperature of 1150° C. or higher, hot-rolling the slab under a condition of a coiling temperature of lower than 620° C., performing pickling, cold-rolling and then recrystallization annealing, and performing temper rolling under a condition of an elongation of less than 3%, wherein the steel sheet is capable of strain aging at room temperature.

3. The method for manufacturing a steel sheet for the bottom of aerosol cans with high resistance to pressure and high formability according to claim 2, wherein the steel sheet has the chemical composition containing, by mass %, and Nf is 0.65 or more where Nf is defined by equation Nf={N−N as AlN}/N, where N in the equation denotes the N content (mass %) in the steel and N as AlN denotes the content (mass %) of N which is present in the steel in the form of AlN.

4. The method of claim 2, wherein the aging treatment is at a room temperature of 25° C.

* * * * *